United States Patent [19]

McKee et al.

[11] Patent Number: 5,069,280

[45] Date of Patent: Dec. 3, 1991

[54] GRAVEL PACKER AND SERVICE TOOL

[75] Inventors: L. Michael McKee, Broken Arrow; Joseph D. Scranton, Tulsa; Robert L. Brookey, Jenks, all of Okla.; Derrel Gurley, New Orleans, La.; Ernie Sodich, Caldwell, Tex.

[73] Assignee: Dowell Schlumberger Incorporated, Tulsa, Okla.

[21] Appl. No.: 478,377

[22] Filed: Feb. 12, 1990

[51] Int. Cl.[5] ..... E21B 43/04

[52] U.S. Cl. ..... 166/278; 166/51; 166/120; 166/124; 166/125; 166/217; 166/317

[58] Field of Search ..... 166/278, 51, 120, 125, 166/124, 217, 134, 317

[56] References Cited

U.S. PATENT DOCUMENTS

| | | | |
|---|---|---|---|
| 4,187,906 | 2/1980 | Kovacs | 166/120 |
| 4,190,107 | 2/1980 | Oden et al. | 166/125 X |
| 4,345,649 | 8/1982 | Baugh et al. | 166/120 |
| 4,441,559 | 4/1984 | Evans et al. | 166/120 X |
| 4,526,229 | 7/1985 | Dickerson | 166/120 |
| 4,541,486 | 9/1985 | Wetzel et al. | 166/51 X |
| 4,660,637 | 4/1987 | McGill et al. | 166/120 |
| 4,726,419 | 2/1988 | Zunkel | 166/278 X |
| 4,813,486 | 3/1989 | Wyatt et al. | 166/120 X |
| 4,858,691 | 8/1989 | Ilfrey et al. | 166/51 X |
| 4,862,957 | 9/1989 | Scranton | 166/51 |

*Primary Examiner*—Hoang C. Dang
*Attorney, Agent, or Firm*—Stephen A. Littlefield

[57] ABSTRACT

A gravel packer and service tool combination for use in subterranean wells operates sequentially to lock and seal the packer in the well at a producing formation, release a mechanical connection between the packer and service tool, and open a passage through which gravel packing can be performed. Each operational step can be performed in primary and secondary fluid pressure-responsive modes of operation. The secondary mode of operation can be employed in the event the primary mode of operation fails.

29 Claims, 10 Drawing Sheets

GRAVEL PACKER AND SERVICE TOOL

BACKGROUND OF THE INVENTION

This invention relates generally to equipment for preparing oil and gas wells for production, and more particularly to a novel and improved gravel packer and service tool combination.

PRIOR ART

Gravel packers are used to pack gravel around the screens through which the fluid production of the well enters the production apparatus. Without such gravel packed around the screens, sand will be produced with the fluids which must be removed. Further, there is a tendency for the screens to be eroded away by sand and the like.

It is normally the practice to lower a packer into the well with a service tool, which, after packing, is removed, leaving the packer in place. Generally in the past, the packer and service tool have been connected by a threaded connection which is released by rotating the service tool relative to the packer. The rotation of the service tool to remove it from the packer presents serious problems with deep wells, requiring a very long work string. Even greater problems are encountered in highly deviated, curved, or nonvertical wells.

In order to overcome such problems, packer and service tool combinations have been developed, utilizing fluid pressure to disconnect the service tool from the packer. U.S. Pat. No. 4,660,637 (assigned to the assignee of this invention) describes and claims such a packer/service tool combination. That patent is incorporated herein by reference.

In the packer/service tool combination of the '637 patent, the packer and service tool combination is lowered into the well until the packer is located in the desired location where gravel packing is required. A ball is then dropped down the work string to engage a ball seat in the service tool and seal off portions of the service tool so that tubing pressure can be applied to sequentially perform the various operations required.

When tubing pressure is applied to the service tool in a first relatively low pressure range, slips are radially extended from the packer into gripping engagement with the well casing to lock or set the packer in position within the casing. Thereafter, elastomeric seals are compressed longitudinally of the packer and caused to expand radially into sealing engagement with the well casing.

Subsequently, a higher tubing pressure is applied to release the threaded connection between the packer and service tool. Thereafter, a still higher tubing pressure is applied to move the ball seat to permit the gravel slurry to be pumped down through the service tool into the annulus between the packer and the well casing.

Shear screws are used which shear at progressively higher forces created by progressively higher pressures to provide the required sequence of operations.

SUMMARY OF THE INVENTION

In accordance with the present invention, an improved method and apparatus are provided in which back-up fluid pressure modes of operation are provided to operate the packer and service tool combination if the primary mode of operation fails for any reason. By providing back-up modes of operation, the reliability of the operation of the combination is greatly increased.

In the illustrated embodiment, the primary mode of operation of setting or locking the packer in the well casing and for extending the seals between the packer and the well casing is performed by applying tubing pressure in a first fluid pressure range. First shear screws shear off at a relatively low pressure, and the slips then extend into engagement with the well casing, where they bite into the casing to lock the packer in position within the well. As the pressure increases to a higher pressure, second shear screws shear, and the pressure causes compression of an elastomeric seal which expands radially to provide a seal between the packer and the well casing. A ratchet operates to lock the slips of the seal in their operated positions.

In the event subsequent pull tests and pressure testing establish that the primary mode of setting and sealing the packer has been unsuccessful, for example, as a result of the ball's failure to properly seat and seal, a second larger secondary ball is dropped down which seats in a secondary ball seat to seal off the service tool and permit setting and sealing of the packer. By providing such back-up mode of operation, operational reliability is improved.

After the packer is locked in place or set and sealed within the well, the next operation involves the release of the threaded connection between the service tool and the packer. Here again, primary and back-up modes of operation are provided.

With the primary mode of operation, the tubing pressure is increased to a higher value, causing a third set of shear screws to shear. This releases a hydraulic release piston, which then moves up to move a release ring from inside a threaded collet. The threaded collet then springs radially inward, causing release of the threaded connection.

Here again, if the primary mode of release is ineffective, a back-up mode of operation is available. With the back-up mode of operation, pressure is applied to the annulus between the packer/service tool combination and the well casing. When sufficient pressure differential is established between the high annulus pressure and the relatively low tubing pressure within the tool, the third set of shear screws shear and the hydraulic release piston is free to move in response to even lower tubing pressure. Such movement removes the release ring from the threaded collet and releases the threaded connection.

If in the unlikely event that the release is not achieved with either the primary or secondary pressure-operated modes of operation, a third release mode of operation is available, which involves rotating the service tool relative to the packer to unscrew the threaded connection therebetween.

After the connection between the service tool and the packer is released, the seal provided by the ball in the primary ball seat must be removed to allow the actual gravel packing operation. Here again, two modes of operation are available. In one mode of operation, a still higher tubing pressure is applied to shear a fourth set of shear screws and allow the ball seat to move clear of passages through which a slurry of gravel is pumped into the annulus around the packer. In the other mode of operation, the annulus pressure is raised above the tubing pressure to shear the fourth set of shear screws. Once these shear screws are sheared, a low tubing pressure is adequate to move the valve seat to a position for gravel packing.

Therefore, one important aspect of this invention is the provision of a packer/service tool combination in which multiple modes of operation are provided for each operational sequence. With such combinations, a successful packing operation of the well can be achieved even when problems are encountered.

Another important aspect of this invention involves a novel and improved structure which automatically aligns the locking slips and causes them to extend uniformly during the setting of the packer. The alignment structure also acts to prevent the slips from extending outwardly during any running or retrieving operation. Such structure also functions to ensure proper retraction of the slips when packer removal is required.

Another important aspect of this invention involves a novel and improved ratchet structure for locking the slips and the seal in their operative or set positions and which can be reliably released when the packer is to be moved from its set position. Such ratchet lock utilizes a ring which normally functions to lock the slips and the seal of the packer in their set positions, but can be released by axial force which moves a cam into an opening in the ring to spread the ring. The ring and its mounting structure are constructed to ensure that the ring remains substantially centered and releases the mating ratchet in a reliable manner.

Another important aspect of this invention involves the provision of a novel and improved release system for hydraulically disconnecting the service tool from a packer. Release can be accomplished with either of two modes of operation. The first mode involves increasing the tubing pressure above the annulus pressure to a predetermined value so as to release the connection between the service tool and the packer. The second mode of operation is performed by increasing the annulus pressure above the tubing pressure to a predetermined value, to shear a set of shear screws followed by the release of the connection by a relatively small differential pressure, in which the tubing pressure exceeds the annulus pressure.

Still another important aspect of this invention involves a novel and improved system for moving the valve seat so that the actual gravel packing operation can commence. Here again, two modes of operation are provided in which the valve seat can be hydraulically moved. In one mode of operation, a relatively high pressure is applied to the tubing, creating a substantial differential pressure between the annulus and the tubing which is sufficient to shear the shear screws associated with the valve seat. With the second mode of operation, the annulus pressure is increased above the tubing pressure to shear the screws. In this instance, a relatively low differential pressure is operable to perform the shearing operation.

In accordance with still another aspect of this invention, a novel and improved structure is provided to ensure that the annulus pressure exists below the primary valve seat during the hydraulic release of the coupling between the service tool and the packer to ensure that premature release of the valve seat does not occur.

These and other aspects of this invention are illustrated in the accompanying drawings and more fully described in the following specification.

DETAILED DESCRIPTION OF THE DRAWINGS

Figure 1:
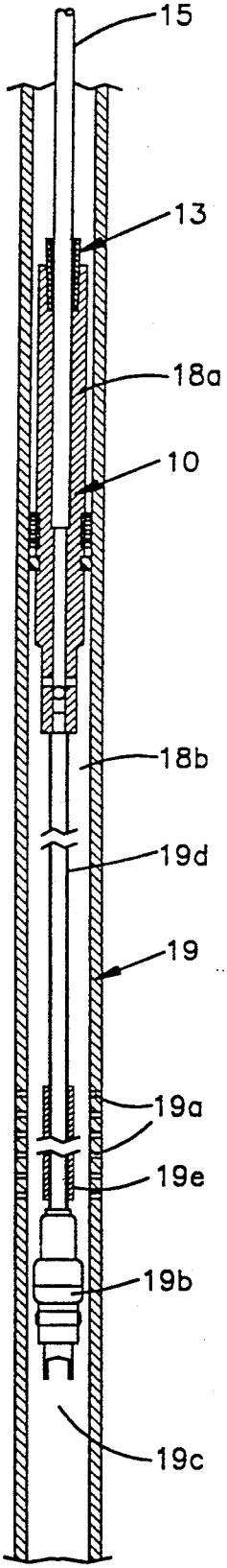
FIG. 1 schematically illustrates a packer and service tool combination incorporating the present invention and which is assembled and lowered into a well for a gravel packing operation.

FIG. 1 schematically illustrates a packer 10 and service tool 13 combination positioned in a well having a casing 19 which has been perforated at 19*a* adjacent to the formation from which production is to be obtained. When the production formation is above the lower end of the well, a sump packer 19*b* is set within the casing below the perforations 19*a* to seal off the rat hole 19*c*. An extension 19*d* extends from the lower end of the packer to the screen 19*e*, through which the oil or gas enters after the packing is completed. During the gravel packing operation, gravel is positioned around the screen 19*e* to prevent sand and the like from eroding the screen and to filter sand out of the produced fluids.

Figure 2:
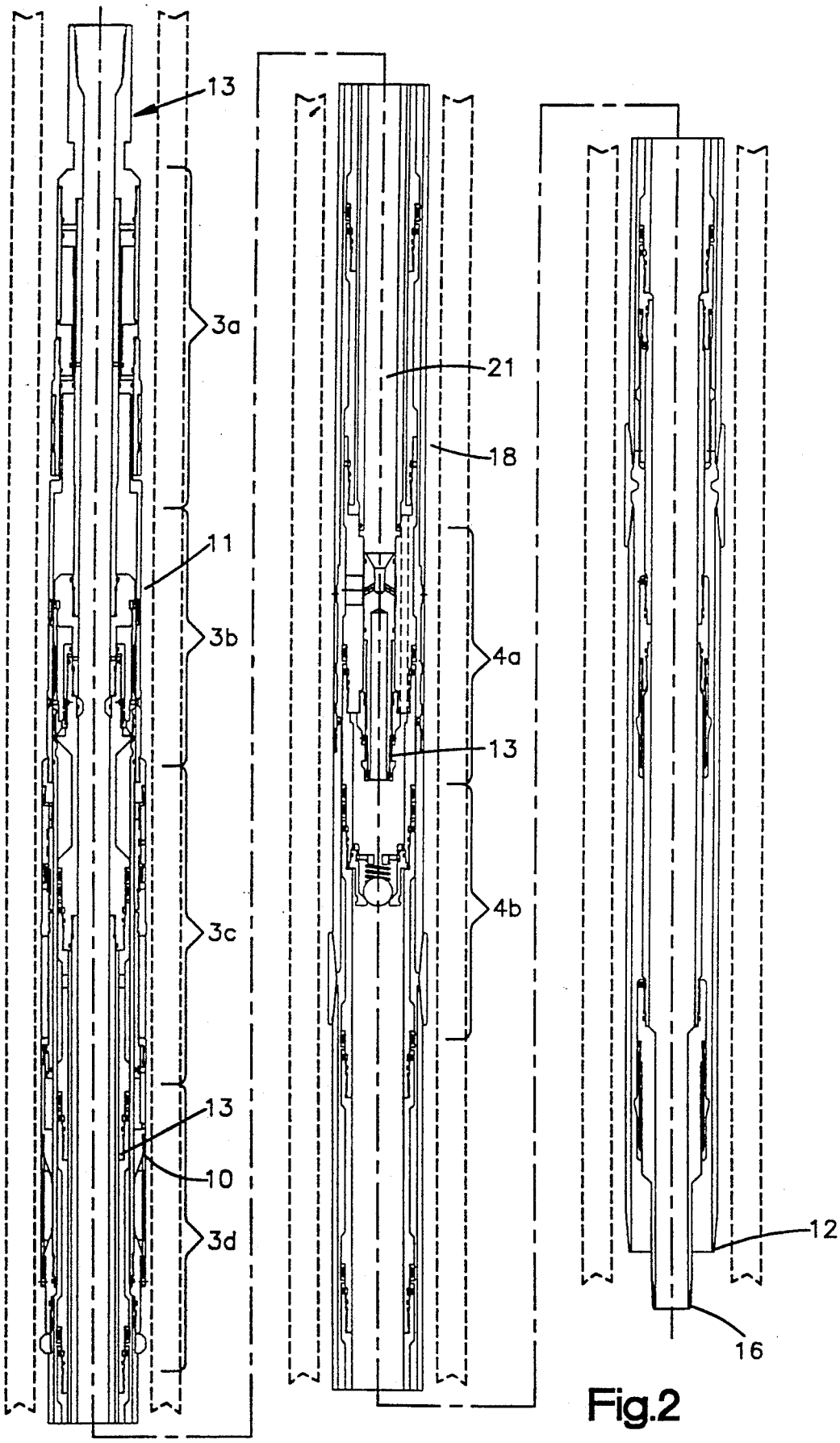
FIG. 2 is a longitudinal section of the packer and service tool.

FIG. 2 illustrates the overall gravel packer/service tool combination. The packer 10 is a tubular assembly which extends from an upper end at 11 to a lower end at 12. It includes a number of functioning subassemblies which will be hereinafter designated with a number designation to indicate an overall subassembly, with the individual parts of the subassembly indicated by such reference numeral followed by a letter.

The service tool 13 is also tubular and telescopes with the packer. The upper end of the service tool 14 is threaded to connect with the work string 15 used to lower the packer/service tool combination into the well to position it for the packing operation. The service tool extends the entire length of the packer to its lower end at 16. Here again, the service tool includes a number of distinct subassemblies, which are also referred to hereinafter by individual reference numerals, with the component parts of the subassembly indicated by such reference numeral followed by a letter designation.

FIGS. 3*a* through 3*d* are enlarged, fragmentary, longitudinal sections. The locations of each of the portions of the combination are designated in FIG. 2 with brackets. FIGS. 4*a* and 4*b* are also enlarged, fragmentary, longitudinal sections illustrating the portions of the combination, also indicated in FIG. 2 by brackets.

Figure 3A:
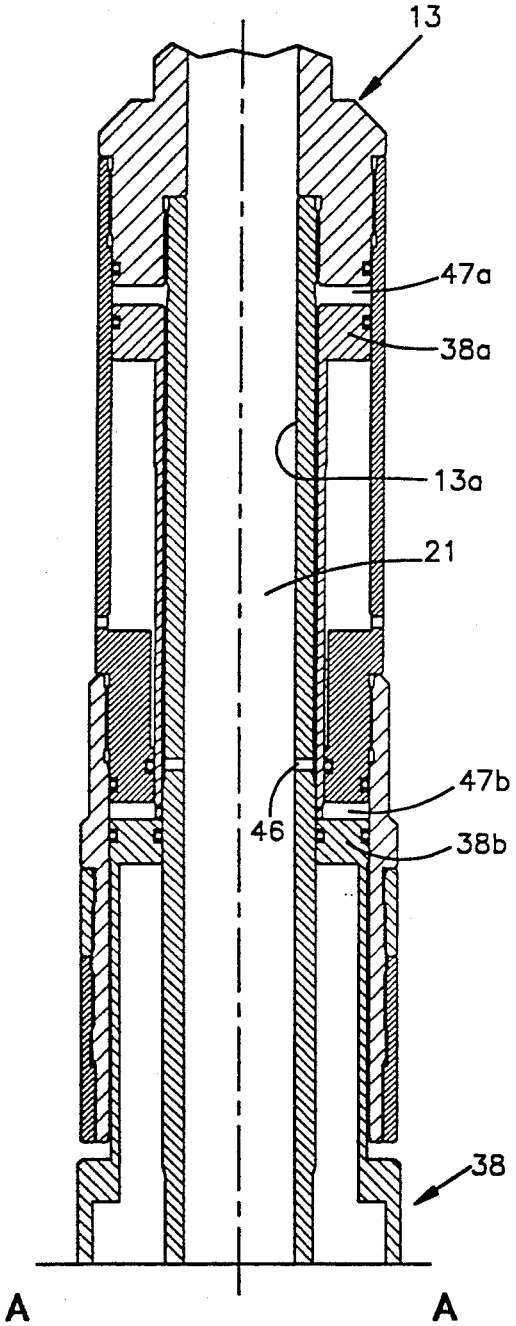
FIGS. 3*a* through 3*d* are fragmentary, longitudinal sections of the portions of the service tool/packer combination designated in brackets in FIG. 2, and includes the portions of the tool which lock the tool in position within the well, form a seal with the well casing, and disconnect the mechanical connection between the service tool and the packer.
Figure 3B:
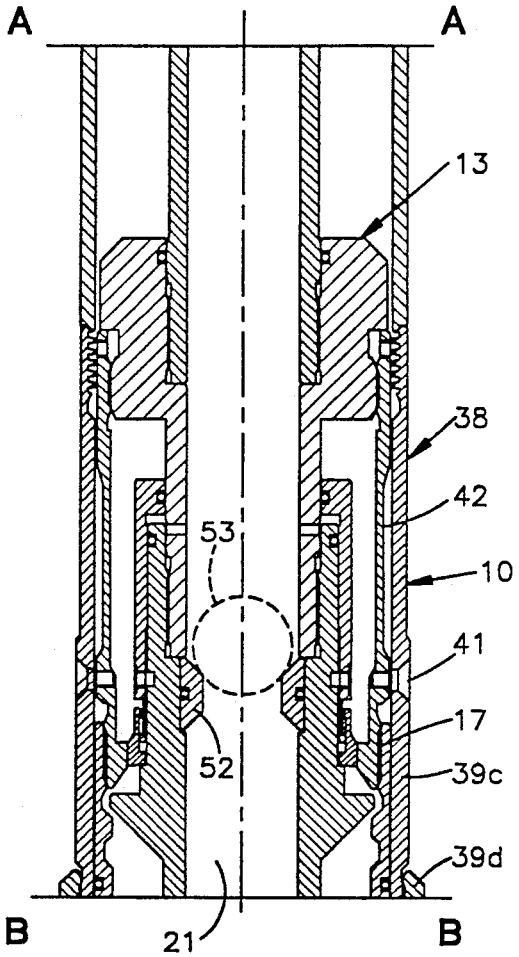
Figure 3C:
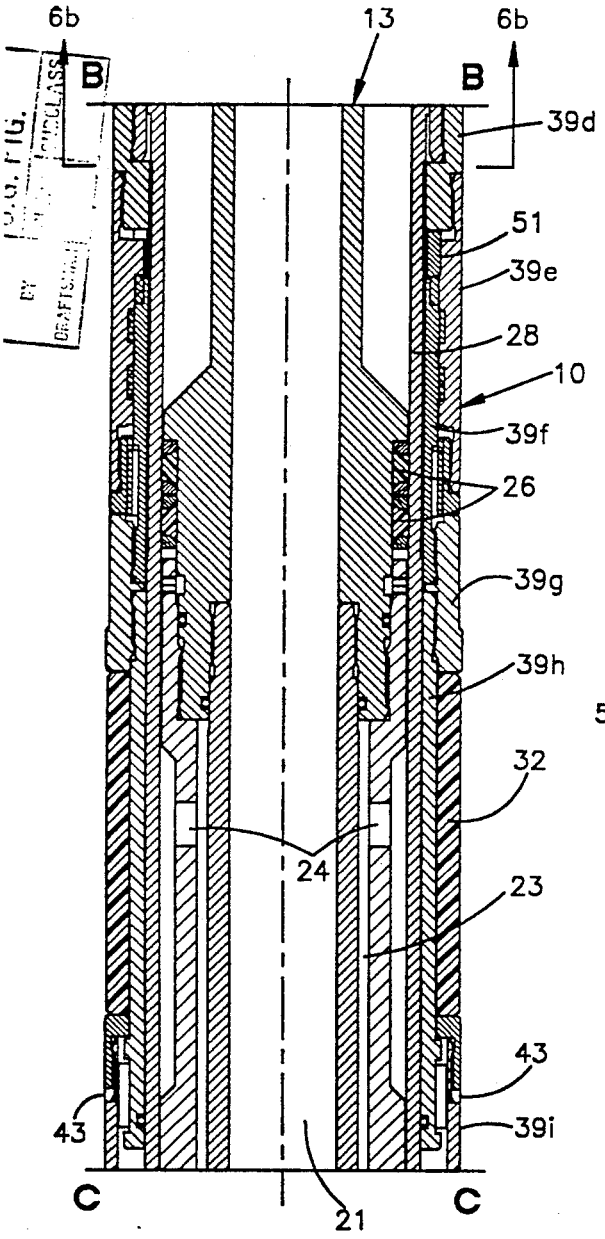
Figure 3D:
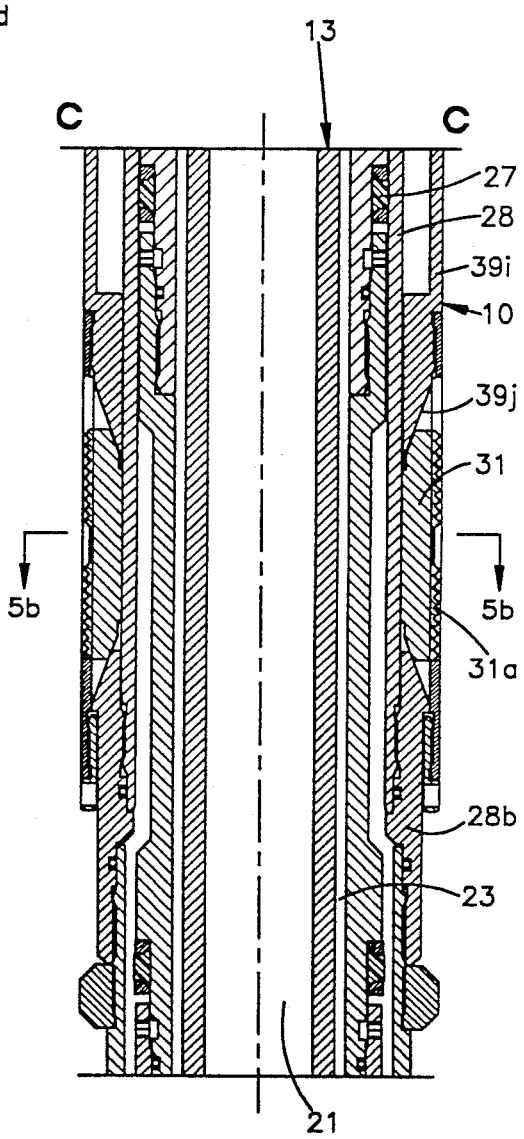
Figure 4A:
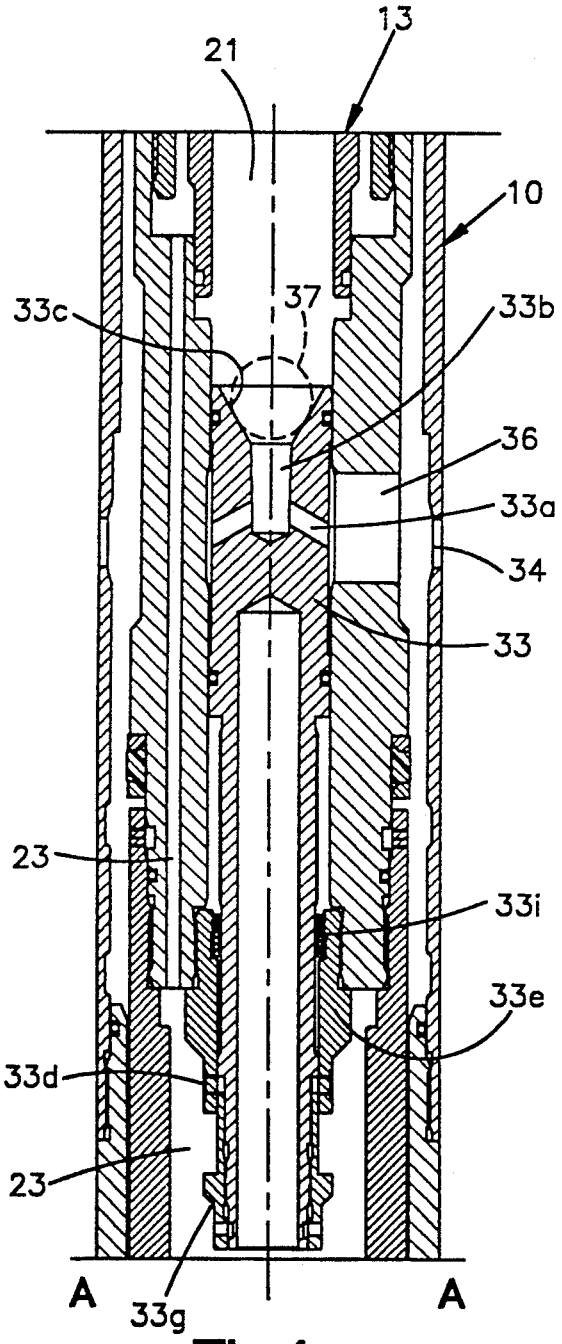
FIGS. 4*a* and 4*b* are additional enlarged, fragmentary sections, illustrating the portion of the tool combination indicated in brackets in FIG. 2.
Figure 4B:
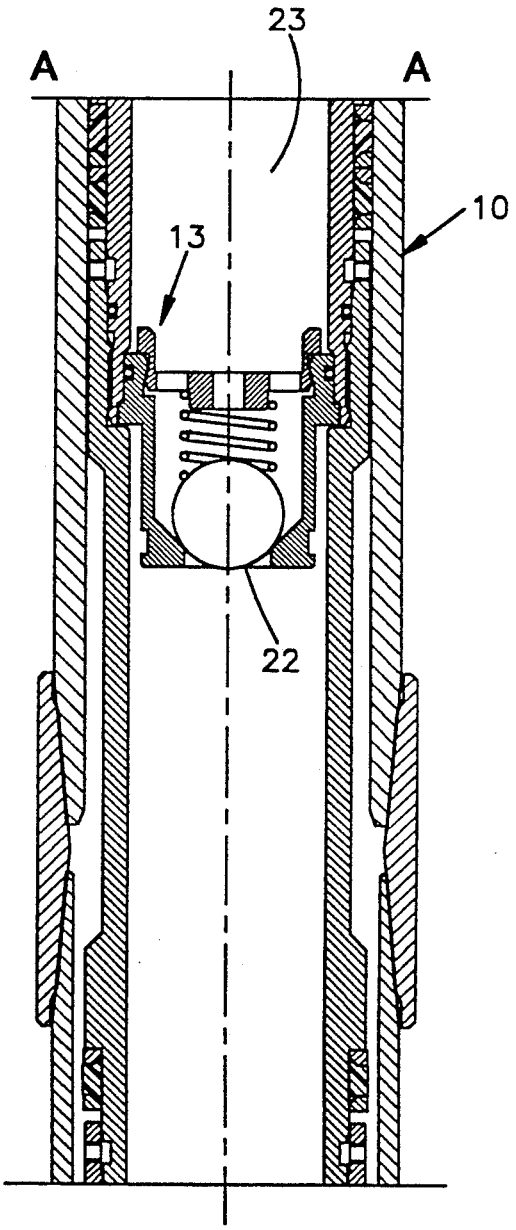

Before the service tool/packer is lowered into the well, the service tool is positioned within the packer and is mechanically connected by a threaded connection at 17, illustrated in FIG. 3*b*, so that the service tool and packer are mechanically locked together.

The various sequential steps of operation of the service tool and packer are performed by fluid pressure-operated subassemblies. These various subassemblies are responsive to differential pressures between the annulus 18 within the well casing 19 and the exterior of the service tool 13 and packer 10 combination (hereinafter referred to as "annulus pressure") and the pressure within the central passage 21 of the tool. Such passage is in communication through the service tool string with the well head and the pressure therein is hereinafter referred to as "tubing pressure." It should be recognized that the absolute pressure in the annulus in the vicinity of the tool is, to a large extent, dependent upon the depth of the tool within the well. Similarly, the absolute pressure within the passage 21 is a function of the depth of the tool assembly from the well head. The operational functions or steps of operation of the tool combination are determined by the differential pressure between the tubing pressure and the annulus pressure, as discussed in detail below, not upon the absolute pressure. Therefore, in the following specification, references to operating pressures and the like are to differential pressure, not static or absolute pressure.

As the service tool and packer are lowered into the well, the absolute pressure of the tool environment increases gradually until the tool is in the position at the formation in which production is to be achieved. A check valve 22, best illustrated in FIG. 4*b*, provides communication between the annulus 18 and an annular passage system 23 which extends up along the service tool 13 around the central passage 21 to lateral ports 24, illustrated in FIG. 3*c*. Seals 26 and 27, respectively located above and below the lateral passages 24, provide a sealing engagement with the adjacent inner tubing member 28 of the packer 10 to seal off the upper end of the passage system 23.

Prior to the lowering of the tool combination into the well, the passage system 23 above the check valve 22 is filled with air. As the tool combination is lowered into the well, the static pressure in the well causes the compression of this air, and ensures that the pressure in the passage system 23 is raised as the static pressure increases, and is therefore equal to the adjacent annulus pressure when the production formation is reached. Since the practice is to maintain well pressure above the pressure in the formation to control the operation of the well, it is important in the subsequent operation of the tool combination to establish and maintain the passage system 23 at the annulus pressure which exists prior to the setting and sealing of the packer. Once the packer is set and sealed, the pressure below the check valve will normally return to the lower pressure of the formation. The check valve 22, however, maintains the pressure in the portion of the passage system 23 immediately below the primary valve seat at the initial annulus pressure. This ensures that excessive differential pressure cannot occur across the primary valve seat during the pressure release of the connection 17 in the second mode of operation described below. Without the check valve, sufficient differential pressure could occur to cause premature shearing of the shear screws anchoring the primary valve seat.

After the packer is properly positioned in the well at the formation in which production is to be obtained, a first step in the operation of the tool is performed to expand slips 31 into locking engagement with the well casing 19. This locks the packer in such location against movement either up or down in the well. Immediately after the slips are extended to lock the packer against the well casing, elastomeric seal 32 is axially compressed and caused to expand radially into tight sealing engagement with the inner surface of the well casing. These operations are performed by establishing a differential pressure between the annulus pressure and the tubing pressure. Therefore, it is necessary to seal off the tubing so that such differential pressure can be established.

A primary valve seat member 33 is mounted in the service tool above the check valve 22. While the tool combination is being lowered into the well, communication is provided between the annulus and the central passage through the primary valve seat by lateral passages 34 in the packer 10, aligned lateral passages 36 in the service tool 13 and passages 33*a* and 33*b* in the primary valve seat assembly which open to the central passage 21 through a conical ball valve seat 33*c*. In order to seal off this connection between the central passage 21 and the annulus 18, a metal ball 37 is dropped down the service string and is moved by gravity down along the central passage 21 into sealing engagement with the ball valve seat 33*c*. FIG. 4*a* illustrates, in phantom, the ball 37 in engagement with the primary valve seat assembly.

Once the ball 37 is in engagement with the primary ball seat, it is possible to increase the tubing pressure in the central passage 21 to a pressure higher than the pressure of the annulus 18, and this pressure differential is utilized to expand the slips 31 into locking engagement with the casing and to then expand the seal 32 into sealing engagement with the casing so that the packer is set and sealed in position.

A fluid pressure-responsive setting and sealing assembly is provided for such operation. The assembly includes an upper piston 38*a* and a tandem lower piston 38*b* mounted in the service tool 13 around a central tube 13*a*. The setting and sealing assembly also includes engagement with the packer at an outer sleeve 39*c* connected to a threaded ring connector 39*d*, which in turn connects with a lower outer sleeve 39*e* of the packer.

Positioned within the lower outer sleeve 39*e* is an upper inner sleeve 39*f* which is connected by a ring connector 39*g* to a lower inner sleeve 39*h* which extends inside and past the seal 32. The inner lower sleeve 39*h* connects at its lower end to a slip expander 39*i*, providing a conical upper slip expanding cam surface 39*j*. The packer inner tubing member 28 extends down along the interior of the portion of the setting and the sealing assembly provided by the packer and is connected at its lower end to a lower slip expander member 28*b*. The expander member 28*b* provides an upwardly facing, conical slip expanding surface 28*c*. The two camming surfaces 28*c* and 39*j* cooperate when they move toward each other to radially expand the slips 31 into tight locking engagement with the well casing.

A first set of shear screws 41 extends through the upper outer sleeve 39*c* into a collet sleeve 42 provided by the service tool and locks the sleeves 39*c* and 39*e* against movement relative to the service tool. A second set of shear screws 43 extends from the slip expander 39*i* into the lower end of the lower inner sleeve 39*h*, and normally locks such members against relative longitudinal movement.

During the initial operation of setting and sealing, the tubing pressure is increased to a value above the annulus pressure by a first relatively low differential pressure to shear the screws 41. The tubing pressure is communicated to the two pistons 38*a* and 38*b* through ports 46 in the inner tubing 13*a* of the service tool. The tubing pressure from the ports 46 communicates with an upper piston chamber 47*a* and a lower piston chamber 47*b*. This first differential pressure created by the elevated tubing pressure results in an axially downward force on the packer outer sleeve 39*c*, which is resisted by the shear screws 41.

The shear screws 41 are sized so that when the pressure differential reaches such low first differential pressure, the shear screws 41 shear, allowing the outer sleeve 39*c* to move relative to the service tool and, in turn, relative to the inner tubing member 28. Such motion is transmitted on down to the slip expander 39*i* and results in movement of the upper slip expander cam surface 39*j* toward the lower slip expander cam member 28*b*. This causes radially outward movement of the slips 31. During such movement, the second set of shear screws 43 prevents relative movement between the slip expander 39*i* and the lower inner sleeve 39*h*. Therefore, the seal 32 is not expanded, and merely moves down with the assembly.

The slips 31 are provided with teeth 31*a* which bite into the well casing to mechanically lock the packer against movement along the well. The manner in which the slips are supported and aligned, described in greater detail below, provides improved setting of the packer within the well casing.

As the slips are forced out into biting engagement, further movement of the slip expander 39*i* is prevented so the differential pressure between the higher tubing pressure and lower annulus pressure increases to a second differential pressure higher than the first differential pressure until the second set of shear screws 43 shear. As soon as the second set of shear screws 43 shears, the lower inner sleeve 39*h* moves relative to the slip expander 39*i* which engages the lower edge of the seal 32. The ring connector 39*g*, which engages the upper end of the seal, moves toward the slip expander 39*i*, causing the seal 32 to be axially shortened and radially expanded. This action continues until the seal 32 is radially extended into tight sealing engagement with the well casing to isolate the upper annulus 18*a* from the lower annulus 18*b*.

Figure 6A:
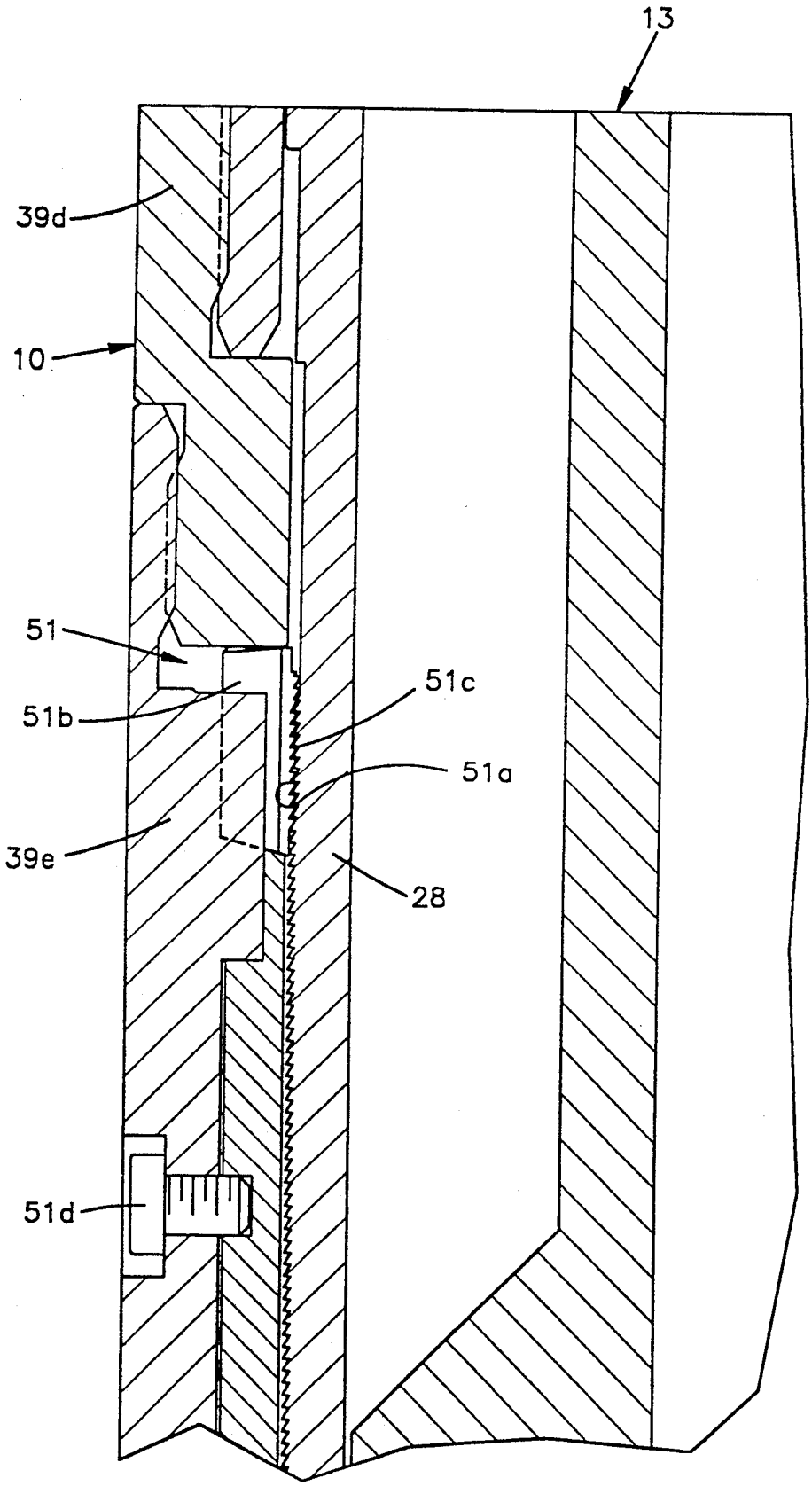
FIG. 6*a* is an enlarged, fragmentary section of the ratchet mechanism for maintaining the slips extended and the seal compressed.
Figure 6B:
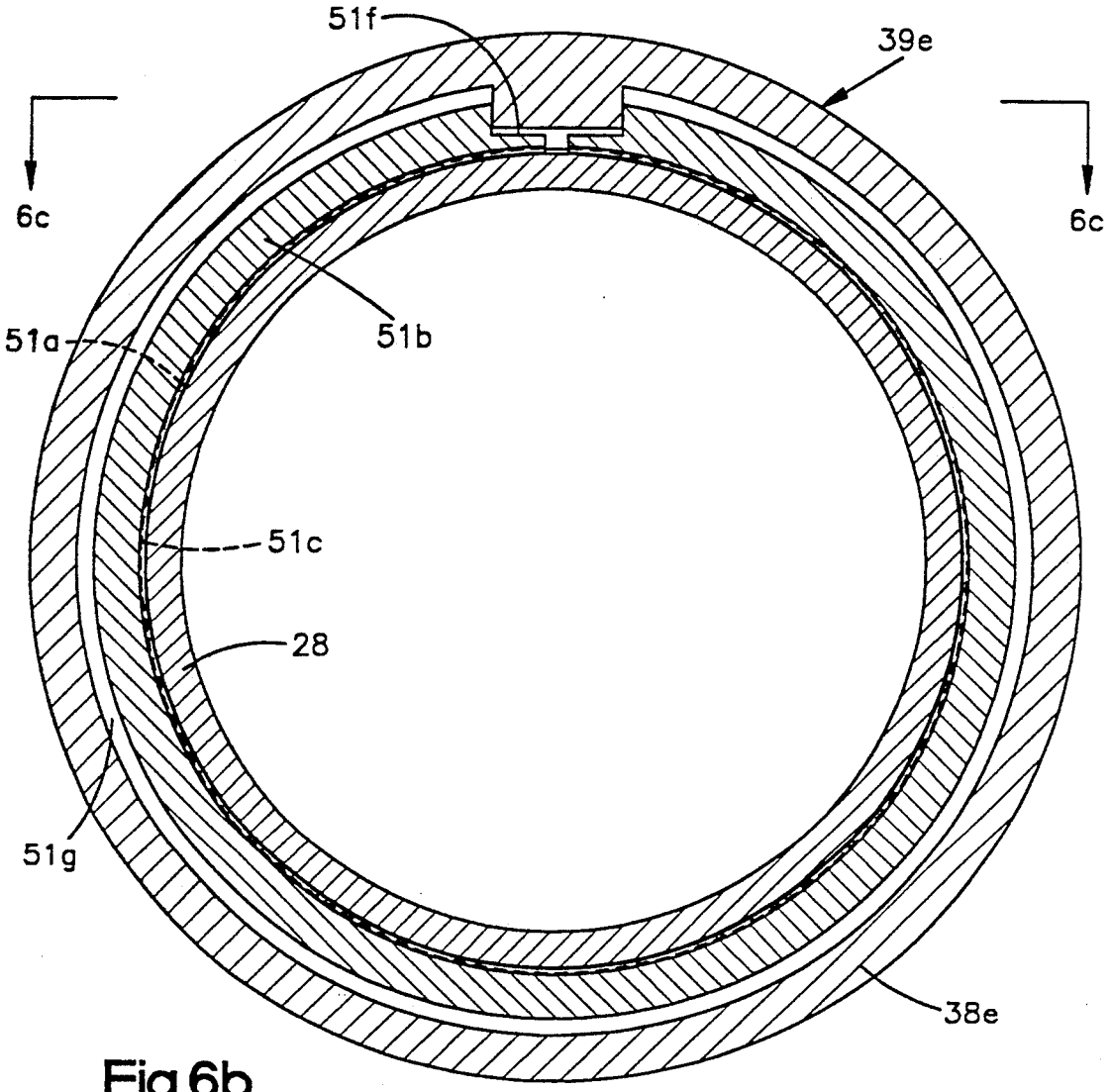
FIG. 6*b* is a cross section taken along line 6*b*—6*b* of FIG. 3*c;*
Figure 6C:
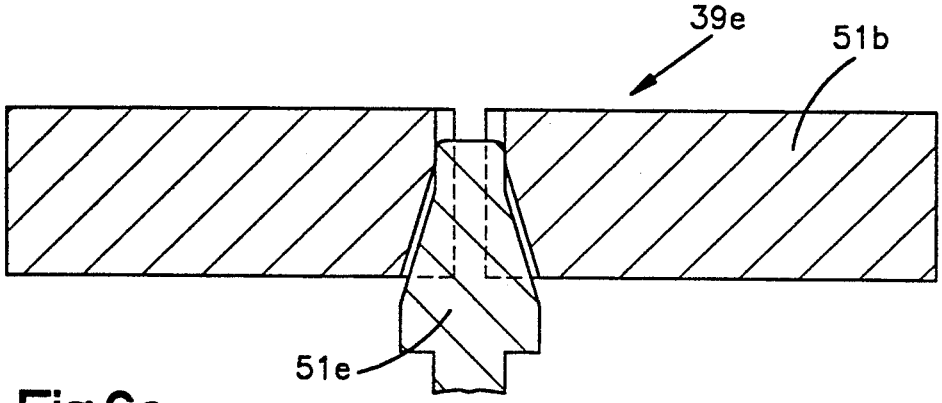
FIG. 6*c* is a fragmentary section taken along line 6*c*—6*c* of FIG. 6*b*, with parts removed for purposes of illustration.

An improved ratchet assembly 51, best illustrated in FIGS. 6*a*–6*c*, includes sawtooth ratchet teeth 51*a* formed along the outer surface of the inner tubing member 28 and a ratchet ring 51*b* formed with internal ratchet teeth 51*c* which interengage and mate with the external ratchet teeth 51*a*. As the slips are extended and the seal 32 is extended into sealing engagement with the well casing, the ratchet ring 51*b* is carried down along the inner tubing member 28. The ratchet ring is formed with a slot opening along one side (discussed in greater detail below) which allows the ratchet tooth to cam the ring open as it moves out along the inner ratchet teeth 51*a*. However, relative movement in the opposite direction is prevented. Therefore, at the completion of the setting and sealing operation, the slips 31 are locked in their extended position and the seal 32 is locked in its expanded and sealing position.

Before proceeding, the locking provided by the slip 31 and the seal provided by the seal 32 are tested. Alternate tensile and compressive forces are applied through the work string to test the locking of the slips. The function of the seal is tested by raising annulus pressure. A build-up of pressure differential indicates that the sealing is performed.

In some instances, difficulty is encountered in establishing the higher tubing pressure and a back-up mode of operation is provided. Such problem in building up tubing pressure can occur, for example, if scale or rust prevents proper sealing of the ball 37 in the primary ball seat 33*c*. The back-up mode of operation which is employed in the event of an unsuccessful setting and sealing operation utilizing the first mode of operation described above is then initiated.

A secondary valve seat 52 (illustrated in FIG. 3*b*) is mounted in the service tool above the primary valve seat assembly 33. The minimum diameter of the secondary valve seat is greater than the diameter of the ball 37, so that the ball 37 can pass the secondary valve seat and move to the primary valve seat. In the event of failure to operate with the first mode of operation utilizing the ball 37, a second ball 53 of larger diameter is dropped down the work string and moves into engagement with the secondary valve seat 52. This secondary ball 53 is not utilized if the primary ball 37 properly seats and seals. The ball 53 is usually formed of a phenolic resin or the like, and can be flushed up the well string and out of the well by reverse flow at a subsequent stage in the operation of the tool. After the secondary ball valve 53 is positioned, the slips are extended to set the packer, and the seal 32 is compressed to expand and seal by the application of a tubing pressure which is higher than the annulus pressure, in the same manner described above for the first mode of operation.

After the setting and sealing operation has been completed and successfully tested, the next step in the operation of the packer and service tool combination involves the release of the threaded mechanical connection 17 between the service tool and the packer so that the service tool can be moved axially relative to the packer. Here again, two modes of operation are provided so that in the event the first mode of operation fails for any reason, a separate and distinct mode of operation is available.

Figure 7:
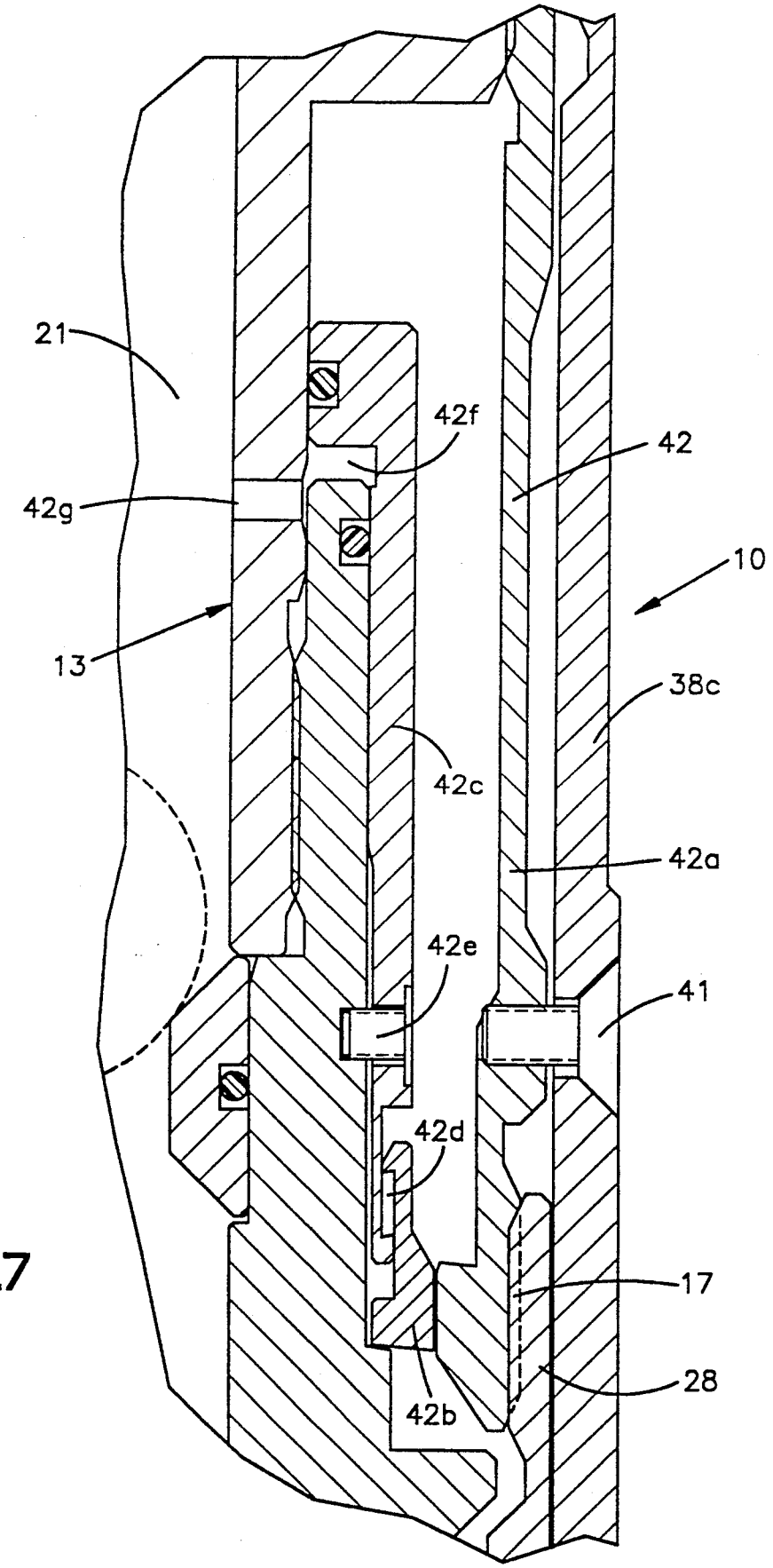
FIG. 7 is an enlarged, fragmentary, longitudinal section illustrating the structural detail of the mechanical connection between the service tool and the packer, along with the fluid pressure-responsive mechanism for releasing such connection.

The mechanical connection 17 between the service tool 13 and the packer 10 is best illustrated in FIG. 7. The connection 17 is provided by internal threads formed of an inner tubing member 28 of the packer which mate with external threads on the collet sleeve 42 of the service tool. This threaded connection is a left-hand thread so that in the event the two fluid pressure-responsive modes of operation of the release of the service tool fail, the service tool can be threaded out of the packer by rotation of the service string.

The lower end of the collet sleeve 42 is provided with longitudinal slots (not illustrated) so that the collet sleeve per se is formed by a plurality of axially extending fingers 42*a* having the external threads at the lower ends thereof. These fingers 42*a* are held radially out in mating engagement with the threads on the tubing member 28 by a locking ring 42*b* positioned within the fingers 42*a* within the envelope of the threaded connection 17.

The threaded connection 17 is released to release the service tool from the packer by moving the lock ring upwardly to a release position in which the fingers 42*a* can then move radially inward to release the threaded connection 17. Such movement of the lock ring 42*b* is provided by a piston 42*c* connected to the lock ring 42*b* by a lost motion connection 42*d*. The plurality of shear screws 42*e* lock the piston 42*c* against movement relative to the service tool until the hydraulic release of the service tool is required. These shear screws are sheared by one of the two pressure-responsive modes of operation provided for the release of the service tool.

With the first mode of operation, the tubing pressure within the central passage 21 is increased above the annulus pressure within the annulus 18*a* and is communicated to the chamber 42*f* through lateral ports 42*g*. When the differential pressure reaches a third differential pressure higher than the second differential pressure, the shear screws 42*e* shear, causing upward movement of the piston 42*c*. After the piston has moved through the lost motion distance, further movement of the piston 42*c* raises the lock ring 42*b* and allows the fingers 42*a* to spring inwardly to release the threaded connection 17 between the service tool and the packer. The fingers 42*a* are prestressed so that as soon as the lock ring is moved upwardly, they spring inward to release the threaded connection 17.

In the event that the threaded connection 17 fails to release in response to elevated tubing pressure, a second mode of fluid pressure-responsive operation is provided in which the annulus pressure within the upper annulus 18*a* is increased to a value above the tubing pressure within the passage 21. When the annulus pressure is raised to a value above the tubing pressure by a third differential pressure, the screws 42*e* shear, allowing downward movement of the piston 42*c*. This movement, by itself, does not cause release of the lock ring 42*b*; however, after the screws 42*e* have sheared, the piston can be raised by a low differential pressure in which the tubing pressure exceeds the annulus pressure. Such low pressure can be achieved even if sufficient differential pressure cannot be obtained for the first mode of operation to shear the screws 42*e*. Therefore, in the second mode of operation, after the shear screws are sheared, the tubing pressure is raised above the annulus pressure to cause upward movement of the piston and release of the lock ring 42*b*.

In the unlikely event that both the first and second modes of operation for pressure release of the threaded connection 17 fail, as a third release mode of operation, the service tool can be rotated by the work string to thread the fingers out of the threads on the inner tubing member 28.

If the secondary ball valve 53 has been required and is positioned in the valve seat 52, reverse circulation is necessary to blow the ball valve 53 up the work string out of the well. For reverse circulation, the service tool is raised to lift the upper seals out of the packer so that fluid pumped down through the upper annulus 18*a* enters the central passage through the passages 36 and flows up the tubing to the surface. Such flow carries the secondary ball 53 up out of the well, clearing the tool system for further operations.

Figure 8:
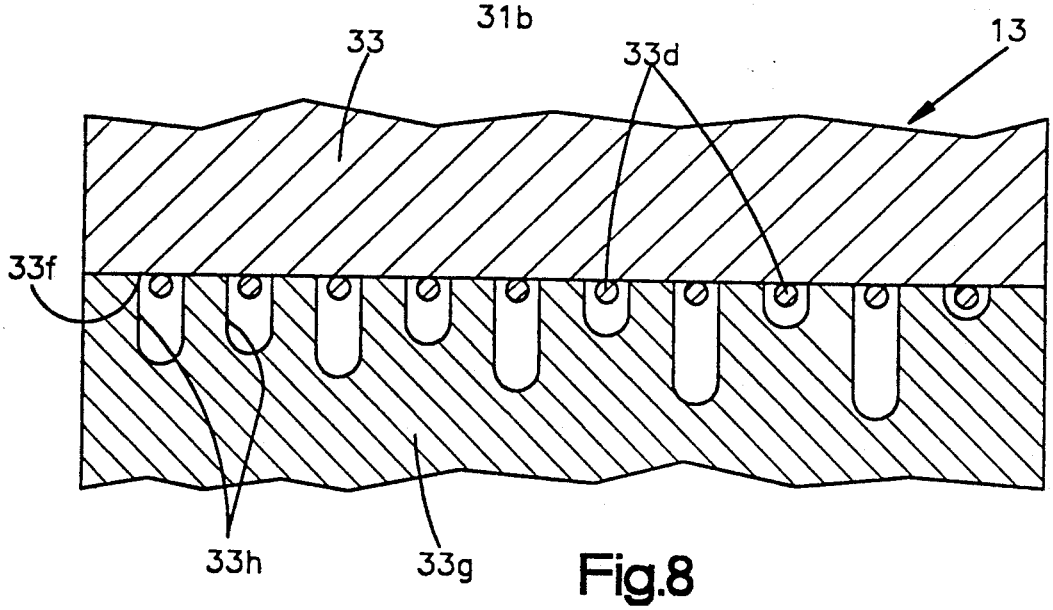
FIG. 8 is a fragmentary roll-out view of the cutter sleeve operable to shear the shear screws which lock the primary valve seat in position.

The subsequent and last step of operation prior to the actual gravel packing requires the movement of the primary ball seat, with the primary ball 37 seated therein down until the passages 36 are open. Here again, two distinct modes of operation are available to ensure the reliability of operation of the tool. The primary valve seat assembly 33 is also locked in its normal position illustrated in FIG. 4*a* by a plurality of shear screws 33*d* threaded into a shear screw receiving ring 33*e*. As illustrated in the roll-out view of FIG. 8, these screws are in abutment on their upper sides by a downwardly facing flat surface 33*f* on the primary valve seat member 33 and which prevent downward movement of such member until the shear screws 33*d* are sheared. Positioned below the shear screws is a sleeve 33*g* which is threaded onto the lower end of the primary valve seat member 33. The upper ends of the sleeve 33*g* are formed with grooves 33*h*, with one groove 33*h* adjacent to each of the shear screws 33*d*. As best illustrated in FIG. 8, the depth of the grooves 33*h* is progressively increased so that in one mode of operation for shearing the shear screws 33*d*, only a single screw is fractured or sheared at any given time and the shear screws are progressively but singly sheared.

In a first mode of operation, tubing pressure higher than annulus pressure is utilized to shear the screws 33*d* to allow downward movement of the primary valve seat 33. Before the shearing operation is commenced, the service tool is raised a sufficient distance so that the seals 26 clear the upper end of the tubing member 28, to provide direct communication through the ports 24 between the annulus 18*a* and the portion of the passage system 23 immediately below the primary valve seat member 33. In the first mode of operation, the tubing pressure is again raised to a value above the pressure in the upper annulus (and the passage system 23) until a fourth differential pressure higher than the third differential pressure is reached. At such differential pressure, the shear screws 33*d* shear and the primary valve seat member 33 is carried downwardly until it clears the passages 36. At such time, the packing operation can be commenced.

In the event that the first mode of operation fails to cause shearing of the shear screws 33*d* for any reason, a second mode of operation is again provided to release the primary valve seat member 33 so that it can be moved down clear of the passages 36. The annulus pressure is then raised above the tubing pressure, producing an upward force on the primary valve seat member. This upward force causes the sleeve to move in an upward direction.

In this instance, only a single shear screw resists such upward movement at any given time, since the shear screw associated with the groove 33*h* of least depth is the only shear screw initially engaged. Therefore, the full pressure resultant force in an upward direction is applied to a single shear screw and results in shearing of such screw when the annulus pressure exceeds the tubing pressure by a fifth differential pressure which is substantially lower than the fourth differential pressure. As soon as the first screw shears, the assembly moves up until the groove 33*h*, which is slightly greater in length, engages and shears one more shear screw. This action continues progressively until all of the shear screws 33*d* are sheared, thereby releasing the primary valve seat member 33. With this structure, in which the shear screws 33*d* are progressively sheared rather than simultaneously sheared, the shearing operation to be performed with very low differential pressure compared to the pressure required in the first mode of operation. If desired, the grooves can be structured to simultaneously shear two or more screws. However, in such case, a higher differential pressure is required. Once all of the shear screws have been sheared, the pressure differential is reversed to establish a higher tubing pressure than annulus pressure and a relatively low differential pressure is all that is required to overcome the friction and move the primary valve seat member down clear of the passages 36. A ratchet ring 33*i* engages external ratchet teeth to ensure that once the primary valve seat is moved down clear of the passages 36, it remains in such operating position.

Gravel packing is accomplished by lowering the service tool back until the seals enter the packer so that gravel pumped down along the tubing passes out through the passages 36 and 34 into the lower annulus 18*b*.

Once the gravel packing is completed, the service tool is removed and a production tool string is lowered into the well and is connected to the upper end of the packer.

In some instances, it is necessary to remove a set and sealed packer. When this is necessary, a recovery tool is lowered into the well and connects with the outer sleeve 39*c* at its upper end. An upward force is then applied of sufficient magnitude to shear a set of shear screws 51*d*, allowing the lower outer sleeve 39*e* to move up and cam the ratchet ring 51*b* open out of engagement with the external ratchet teeth 51*a*. FIGS. 6*a* through 6*c* best illustrate the structure of the ratchet ring 51*b* and a cam 51*e*, which operates to spread the ratchet ring after the shear screws 51*d* have sheared. The ratchet ring 51*b* is formed as a split ring, stressed inwardly to maintain engagement between the external ratchet teeth 51*a* and the internal ratchet teeth 51*c*. The cam 51*e* is formed on the interior of the outer sleeve 39*e* and shaped to enter the opening 51*f* and spread the ring when the outer sleeve 39*e* is pulled upward by the recovery tool.

The clearance 51*g* provided between the outer surface of the ratchet ring 51*b* and the inner surface of the outer sleeve 39*e* is proportioned with respect to the dimensions of the cam 51*e* so that the cam spreads the ratchet ring a sufficient amount to ensure that the internal ratchet teeth 51*c* clear the external ratchet teeth 51*a* even when the ratchet ring 51*b* moves off center a maximum distance permitted by such clearance 51*g*. The cam, however, is sized so that even when the cam fully spreads the ratchet ring, the diameter of the outer surface of the ratchet ring 51*b* is still less than the diameter of the inner surface of the sleeve 39*e*. This ensures that jamming does not occur in the event that scale or other debris collects around the ratchet ring during the time the packer is in the well.

Once the ratchet ring releases, the sleeve 39*e* is moved upward by the tension applied by the recovery tool and the compression of the seal 39*h* is released. Similarly, such motion is transmitted to the slip expander 39*i*, which also moves upwardly to release the slips. As discussed in greater detail below, the slips are retained in a slip retaining ring 31*b*, which is connected to the slip expander 39*i* for movement therewith. If the lower ends of the slips fail to release by moving upwardly relative to the lower slip expanding cam member 28*b*, the upward movement of the slip retainer 31*b* lifts the slips up and ensures their release. Once the slips are released and the compression in the seal is released, the packer is free to be removed from the well by the recovery tool.

Figure 5C:
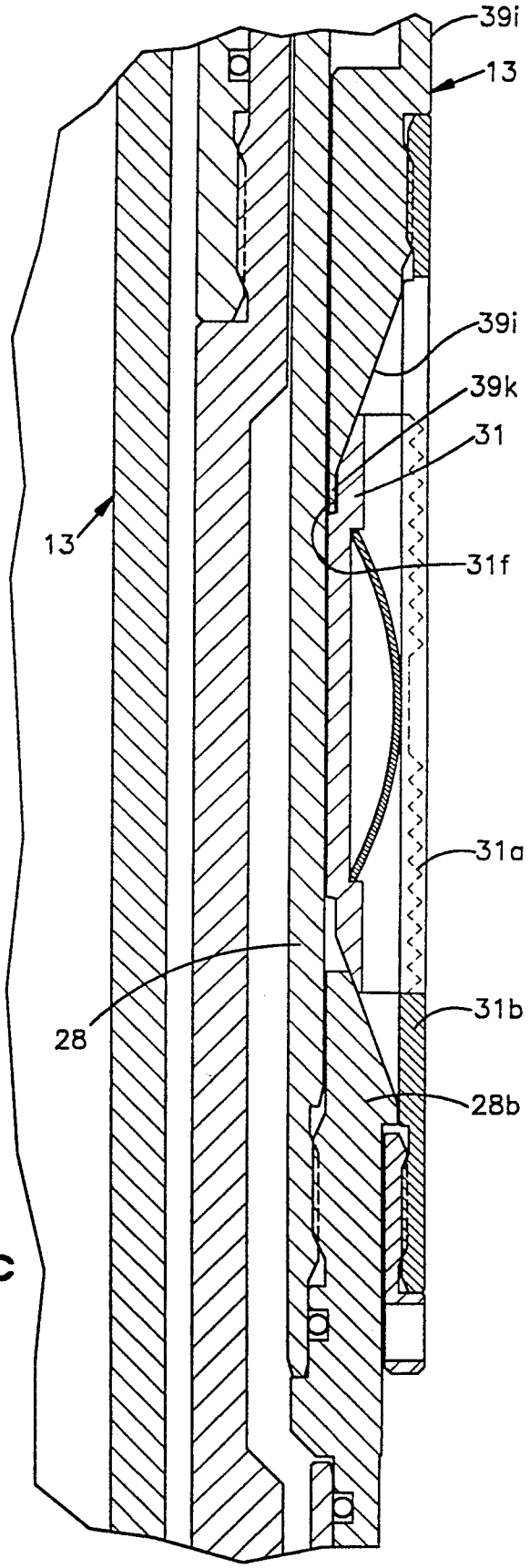
FIG. 5*c* is a fragmentary, longitudinal section taken along line 5*c*—5*c* of FIG. 5*b;*
Figure 5A:
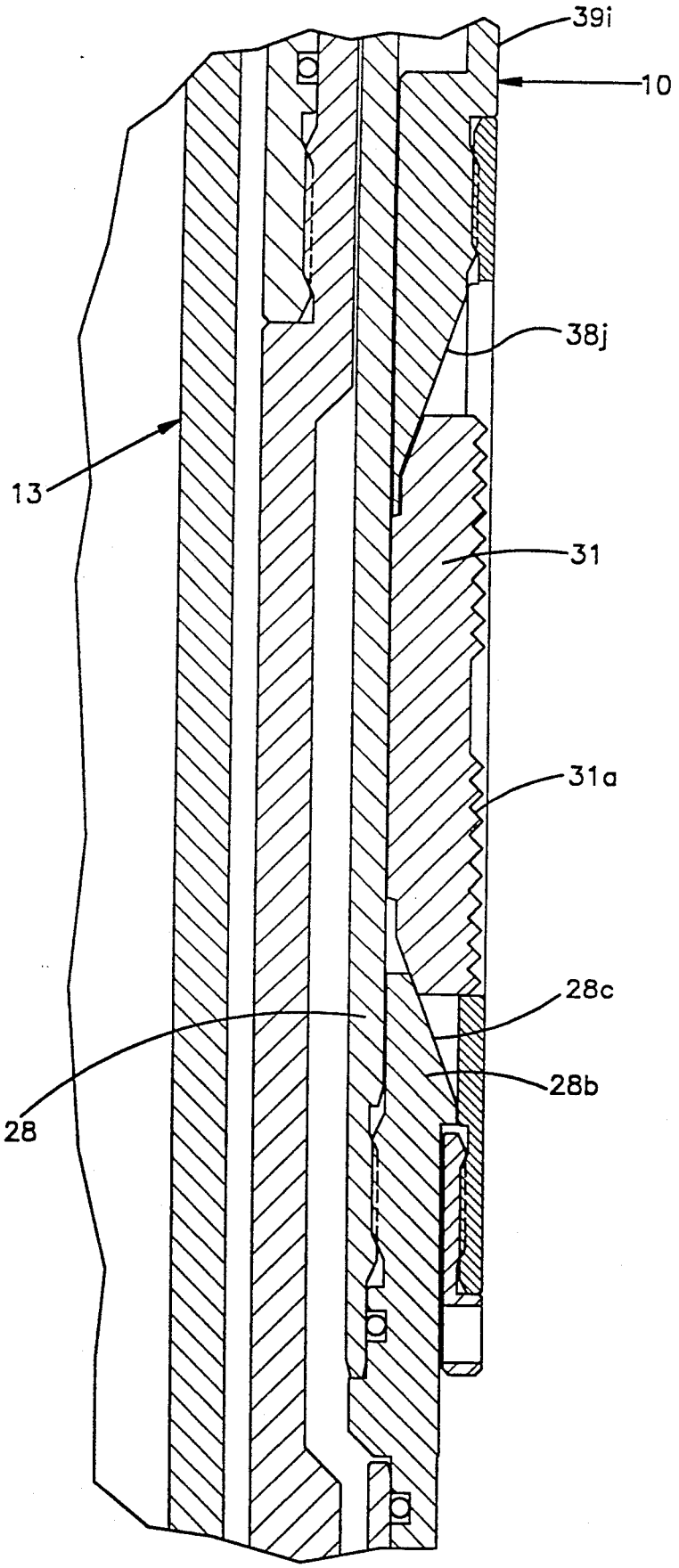
FIG. 5*a* is a greatly enlarged, fragmentary, longitudinal section of the structure adjacent to the slips.
Figure 5B:
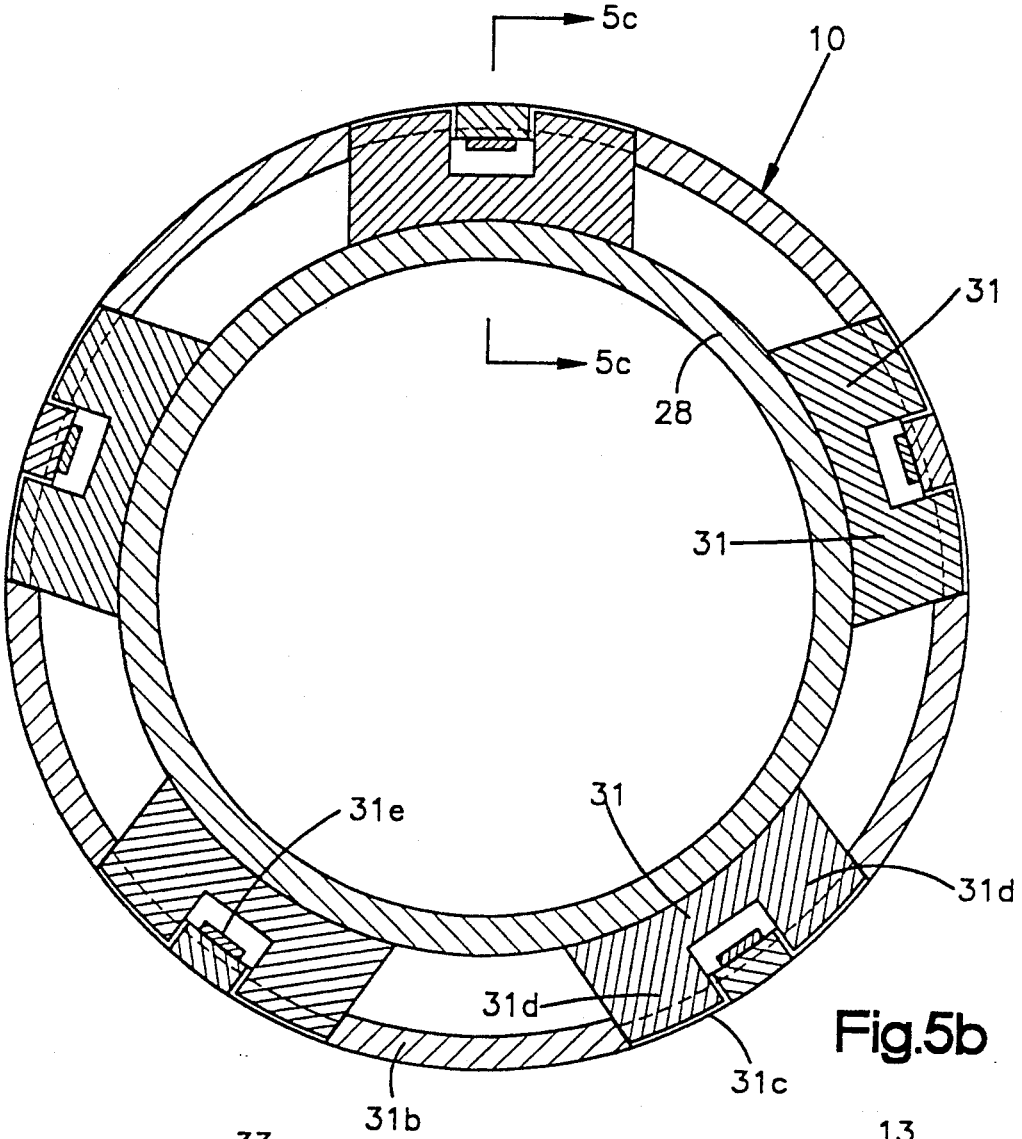
FIG. 5*b* is a cross section taken along line 5*b*—5*b* of FIG. 3*d;*

FIGS. 5*a* through 5*c* illustrate the structural detail of improved mounting of the slips 31 and their operating cams. The slips 31 are formed with a generally U-shape illustrated in FIG. 5*b*, and provide legs 31*d* which extend out through longitudinal slots 31*c* in the slip retainer sleeve 31*b*. A spring 31*e* is positioned between the legs 31*d* and normally maintains the slips in their retracted position against the inner tubing member 28.

In order to ensure that all of the slips remain retracted while the packer is run down the well, the forward end of the cam surface 39*j* is provided with a tongue 39*k* which extends into a mating recess 31*f* in the slips and engages the end of the recess with abutting engagement. This engagement prevents contact between the slips and the casing from causing the slips to expand while the packer is being lowered. However, during the expansion of the packer, the movement of the slips along the surface 28*c* tips the recess out from the tongue 38*k* and allows expansion of the slips.

When the slips 31 are released for retrieval of the packer from the well, the upward movement of the slip expander 39*i* causes the slip retainer 31*b* to engage the lower ends of the slips and ensures that none of the slips hang up on the lower slip expander cam surface 28*c*. Such engagement also ensures that the slips do not extend during retrieval of the packer.

With the present invention, the reliability of operation is substantially improved by providing alternate modes of operation for each of the operating steps required in the preparation of the packer for the actual gravel packing. Further, individual subcomponents or combinations are structured for improved reliability in operation. For example, the check valve 22 prevents premature shearing of the shear screws which lock the primary valve seat in position. The slips are supported and structured for reliable, uniform operation. The shearing of the shear screws locking the primary valve seat in position can be accomplished with low differential pressure in the mode of operation involving an annulus pressure higher than tubing pressure. Further, the ratchet system for holding the slips extended and the seal compressed operates reliably and can be released in a reliable manner when the packer is to be retrieved.

Although the preferred embodiment of this invention has been shown and described, it should be understood that various modifications and rearrangements of the parts may be resorted to without departing from the scope of the invention as disclosed and claimed herein.

What is claimed is:

1. A packer service tool combination for use in wells having well casings, comprising a tubular gravel packer and service tool combination, said service tool and packer being mechanically connected, said combination being operable sequentially through the operational steps of:

(a) extending slips to lock said packer in said well casing;

(b) extending seals to establish a seal between said packer and said well casing, (c) releasing a mechanical connection between said service tool and packer, and (d) opening a passage in said service tool to allow gravel packing;

first fluid pressure-responsive means operating to extend said slips and extend said seals, second fluid pressure-responsive means for releasing said mechanical connection between said service tool and packer, and third fluid pressure-responsive means operating to open said passage, said second fluid pressure-responsive means being operable in a first mode of operation in response to a tubing pressure within said service tool higher than the pressure in an annulus around said service tool, and in a second mode of operation in response to annulus pressure in said annulus exceeding said tubing pressure.

2. A combination as set forth in claim 1, wherein said third fluid pressure-responsive means provides a first mode of operation responsive to tubing pressure higher than annulus pressure and a second mode of operation responsive to annulus pressure higher than said tubing pressure.

3. A combination as set forth in claim 1, wherein said first fluid pressure-responsive means includes a primary ball and ball seat for sealing said tubing pressure, and a secondary ball and secondary ball seat operable to seal tubing pressure in the event that said primary ball and ball seat fail to function.

4. A combination as set forth in claim 3, wherein said opening of said passage requires movement of said primary valve seat in response to operation of said third fluid pressure-responsive means.

5. A combination as set forth in claim 4, wherein said third pressure-responsive means is operable in a first mode of operation in response to annulus pressure higher than said tubing pressure and a second mode of operation in response to tubing pressure higher than annulus pressure.

6. A combination as set forth in claim 5, wherein said third pressure-responsive means operates in said first mode of operation in response to a differential pressure between said annulus pressure and said tubing pressure which is substantially lower than the differential pressure therebetween in said second mode of operation.

7. A combination as set forth in claim 6, wherein a plurality of shear elements secures said primary valve seat against movement, said third pressure-responsive means operating to shear said shear elements sequentially in said first mode of operation and simultaneously shear said shear elements in said secondary mode of operation.

8. A combination as set forth in claim 1, wherein shear means are provided operable to sequentially shear in response to fluid pressure and sequence said operational steps.

9. A combination as set forth in claim 1, wherein said mechanical connection between said service tool and packer is releasable by rotation of said service tool in the event that said second fluid pressure-responsive means fails to operate.

10. A packer/service tool combination for gravel packing wells having a well casing comprising a tubular packer, a tubular service tool telescoping with said packer and mechanically connected thereto, said combination being sequentially operable through the operational steps of:

(a) setting said packer by locking and sealing said packer in said well casing, (b) releasing said mechanical connection between said service tool and said packer, and (c) opening a passage through which a slurry of gravel can flow into an annulus between said packer and casing; and fluid pressure-responsive means for producing said sequence of said operational steps, said fluid pressure-responsive means providing first modes of operation for each operational step and second modes of operation for each operational step usable in the event that the related of said first modes of operation fail to function.

11. A combination as set forth in claim 10, wherein said fluid pressure-responsive means is operable to perform at least one of said operational steps in a first mode of operation responsive to annulus pressure in an annulus around said combination higher than tubing pressure within said service tool, and in a second mode of operation responsive to tubing pressure higher than annulus pressure.

12. A combination as set forth in claim 11, wherein said fluid pressure-responsive means operates to release said mechanical connection and open said passage in said first modes of operation in response to annulus pressure higher than tubing pressure and in said second modes of operation in response to tubing pressure higher than said annulus pressure.

13. A combination as set forth in claim 10, wherein said fluid pressure-responsive means includes a primary valve device for sealing said service tool to permit said tubing pressure to exceed said annulus pressure, and a secondary valve device operable to permit said tubing pressure to exceed said annulus pressure in the event said primary valve device fails to function properly.

14. A gravel packer/service tool combination for use in subterranean wells having well casings comprising a seal expandable to form a seal between said packer and casing to separate the annulus between said packer and casing into an upper annulus above said seal and a lower annulus below said seal, a valve member in said service tool exposed on one side to tubing pressure within said service tool and operating to control fluid flow therefrom, shear elements retaining said valve member in a fixed position so long as said tubing pressure within said service tool exceeds said upper annulus pressure by less than a predetermined value, and pressure means maintaining a pressure on the other side of said valve member substantially equal to said upper annulus pressure existing before said seal is expanded and when said lower annulus pressure drops below said upper annulus pressure.

15. A combination as set forth in claim 14, wherein said pressure means includes a check valve isolating said other side of said valve means from said lower annulus pressure when said lower annulus pressure drops below said upper annulus pressure.

16. A combination as set forth in claim 14, wherein said pressure means traps and maintains the pressure on said other side of said valve means which exists in said annulus prior to the operation of said seal.

17. A packer and service tool combination for use in wells having a casing, comprising a tubular packer having:

(a) radially movable slips for engaging and locking said packer in said casing; and (b) a seal radially deformable into sealing engagement with said casing;

a tubular service tool telescoping with said packer and providing piston means movable relative to said packer in response to a first predetermined tubing pressure, movement of said piston means operating to radially extend said slips into locking engagement with said casing and radially deform said elastomeric seals into sealing engagement with said casing, a primary valve seat in said service tool sized and positioned to receive and seal with a primary ball dropped down said service tool to seal said service tool and permit said first predetermined pressure to build up therein, and a second valve seat above said primary valve seat larger than said primary ball, and a secondary ball sized to seat in and seal said secondary valve seat, said secondary valve seat and secondary ball cooperating to seal said service tool permitting establishment of said first predetermined tubing pressure when said primary ball fails to seal with said primary valve seat.

18. A combination as set forth in claim 17, wherein shear elements are provided to prevent said seal from deforming into sealing engagement with said casing until after said slips are radially extended.

19. A combination as set forth in claim 17, wherein said slips and piston means provide camming surfaces which engage to radially expand said slips, and abutting means prevent expansion of said slips while said combination is lowered along said casing.

20. A combination as set forth in claim 19, wherein said abutting means includes a tongue extending into a recess in said slips.

21. A combination as set forth in claim 17, wherein means are provided to prevent radial expansion of said slips during insertion and retrieval of said combination.

22. A packer and service tool combination for use in wells having a casing, comprising a tubular packer having:

(a) slips mounted on said packer for radial movement between a retracted position free from said casing and an extended position engaging and locking said packer in said casing, and (b) a seal radially deformable into sealing engagement with said casing;

opposed cams adjacent to each of said slips operable upon movement toward each other to radially expand said slips;

a tubular service tool telescoping with said packer and releasably connected therewith, said service tool providing piston means operable in response to fluid pressure to cause movement of said opposed cams toward each other to radially expand said slips; and opposed abutting means preventing radial expansion of said slips during insertion of said packer into said well and during retrieval of said packer from said well, one of said opposed abutting means being provided by a substantially radial surface on one of said cams, said radial surface engaging a mating surface on said slips when said slips are in said retracted position preventing relative movement thereof toward said slips while said slips are in said retracted position, movement of the other of said opposed cams operating to disengage said one of said opposed abutting means.

23. A method of performing operations in a subterranean well, comprising lowering a tool combination into said well to a location requiring operations thereon, providing first and second fluid pressure-responsive modes of operation for locking at least part of said tool combination in said well and for expanding seals to form a seal in said well, and using said second mode of operation in the event said first mode of operation fails.

24. A method as set forth in claim 23, including providing a primary valve seat and a primary ball valve to permit pressure buildup in said first mode of operation, and providing a secondary valve seat and secondary ball valve to permit pressure buildup for said second mode of operation.

25. A method of gravel packing a well having a well casing, comprising lowering an interconnected packer and service tool combination into a well to a location requiring gravel packing, and operating said combination through a sequence of operational steps including:

(a) locking said packer in said location and establishing a seal between said packer and said well casing;

(b) releasing said interconnection between said packer and said service tool; and (c) opening a flow path to permit gravel packing: and providing first and second fluid pressure modes of operation for performing each of said operational steps with each said second mode of operation available for performing the related operational step in the event of failure of the related first mode of operation.

26. A method as set forth in claim 25, including performing at least one of said first modes of operation in response to annulus pressure between said packer and well casing higher than tubing pressure within said service tool and the related second mode of operation in response to tubing pressure higher than annulus pressure.

27. A method as set forth in claim 25, including releasing said interconnection between said service tool and packer in response to a differential pressure existing in one direction between annulus pressure around said combination and tubing pressure within said combination, and releasing said interconnection between said service tool and packer in response to a differential pressure in the opposite direction between said annulus pressure and tubing pressure in the event said differential pressure in said first direction fails.

28. A method as set forth in claim 27, including opening said flow path in response to differential pressure in one of said directions, and opening said flow path in response to differential pressure in the other of said directions if said differential pressure in said one direction fails to open said flow path.

29. A packer for use in wells having a casing, comprising a tubular body assembly, slips mounted on said body assembly for radial movement between a retracted position free from said casing and an extended position in locking engagement with said casing, first and second opposed cam means in said body assembly engaging opposite ends of said slips and operating upon movement of said opposed camming means towards each other to cam said slips to said extended position, said first camming means providing a substantially radial surface engaging a mating surface on said slips when said slips are in said retracted position preventing relative movement thereof toward said slips while said slips are in said retracted position, engagement of said second camming means with said slips operating to disengage said radial surface and said mating surfaces as said camming means move toward each other to permit relative movement between said first camming means and said slips for movement of said slips to said extended position.

* * * * *